US005983608A

United States Patent [19]

Wu et al.

[11] Patent Number: 5,983,608

[45] **Date of Patent: *Nov. 16, 1999**

[54] PACKAGING METHOD FOR CONTACT LENSES

[75] Inventors: Jongliang Wu; Daniel Tsu-Fang Wang, both of Jacksonville; Stephen Robert Beaton, Neptune Beach; Kornelis Renkema, Jacksonville, all of Fla.; Wybren Van Der Meulen, Neunen, Netherlands; Victor Lust; Richard Wayne Abrams, both of Jacksonville, Fla.

[73] Assignee: Johnson & Johnson Vision Products, Inc., Jacksonville, Fla.

[ * ] Notice: This patent is subject to a terminal disclaimer.

[21] Appl. No.: 09/104,248

[22] Filed: Jun. 24, 1998

Related U.S. Application Data

[63] Continuation of application No. 08/724,316, Oct. 1, 1996, Pat. No. 5,823,327, which is a continuation of application No. 08/414,514, Mar. 31, 1995, abandoned, which is a continuation-in-part of application No. 08/257,796, Jun. 10, 1994, Pat. No. 5,697,495, which is a continuation-in-part of application No. 08/146,754, Nov. 2, 1993, abandoned.

[51] Int. Cl.[6] ..... B65B 51/10; A45C 11/04

[52] U.S. Cl. ..... 53/478; 206/5.1; 206/469; 206/820; 220/359.1

[58] Field of Search ..... 206/5.1, 205, 461, 206/467, 469, 484, 820; 220/306, 359, 371; 53/476–478, 48.5

[56] References Cited

U.S. PATENT DOCUMENTS

| | | | |
|---|---|---|---|
| D. 299,085 | 12/1988 | Martinez . | |
| 2,361,597 | 10/1944 | Buttery . | |
| 3,398,876 | 8/1968 | Clancy . | |
| 3,456,784 | 7/1969 | Sirago . | |
| 3,605,374 | 9/1971 | Mueller et al. . | |
| 3,650,386 | 3/1972 | Tigner . | |
| 3,715,856 | 2/1973 | Borel | 206/820 X |
| 3,780,856 | 12/1973 | Braverman . | |
| 3,910,487 | 10/1975 | Jaeschke . | |
| 3,983,999 | 10/1976 | Morton . | |
| 4,124,141 | 11/1978 | Armentrout et al. . | |
| 4,495,313 | 1/1985 | Larsen . | |
| 4,565,348 | 1/1986 | Larsen . | |
| 4,640,489 | 2/1987 | Larsen . | |
| 4,680,336 | 7/1987 | Larsen et al. . | |
| 4,691,820 | 9/1987 | Martinez . | |
| 4,889,664 | 12/1989 | Kindt-Larsen et al. . | |
| 5,039,459 | 8/1991 | Kindt-Larsen et al. . | |
| 5,054,610 | 10/1991 | Ajello . | |
| 5,080,839 | 1/1992 | Kindt-Larsen . | |
| 5,094,609 | 3/1992 | Kindt-Larsen . | |
| 5,467,868 | 11/1995 | Abrams et al. | 206/5.1 |
| 5,697,495 | 12/1997 | Abrams et al. | 206/5.1 |
| 5,704,468 | 1/1998 | Lust et al. | 206/5.1 |
| 5,823,327 | 10/1998 | Wu et al. | 206/5.1 |

FOREIGN PATENT DOCUMENTS

| | | |
|---|---|---|
| 604177 | 6/1994 | European Pat. Off. . |
| 2 310 940 | 12/1976 | France . |
| 1063685 | 3/1967 | Germany . |
| 18 15 790 | 5/1970 | Germany . |
| 64-74525 | 3/1989 | Japan . |
| 2216864 | 10/1989 | United Kingdom . |

*Primary Examiner*—Bryon P. Gehman

[57] ABSTRACT

A base member for a blister package for the containment of a contact lens includes a planar flange extending outwardly about a cavity for housing the contact lens. Proximate the peripheral edge of the flange, there is formed a continuous groove into which there is pressed the material of a flexible cover sheet of the blister package so as to clampingly engage the base member.

6 Claims, 3 Drawing Sheets

PACKAGING METHOD FOR CONTACT LENSES

CROSS-REFERENCE TO RELATED PATENT APPLICATIONS

This application is a continuation application of U.S. patent application Ser. No. 08/724,316, filed Oct. 1, 1996, now U.S. Pat. No. 5,823,327, which is a continuation application of U.S. patent application Ser. No. 08/414,514, filed Mar. 31, 1995, now abandoned, which is a continuation-in-part application of U.S. patent application Ser. No. 08/257,796, filed Jun. 10, 1994, now U.S. Pat. No. 5,697,495, which is a continuation-in-part application of U.S. patent application Ser. No. 08/146,754, filed Nov. 2, 1993, now abandoned.

BACKGROUND OF THE INVENTION

1. Field of the Invention

The present invention relates to a packaging arrangement for the containment of at least one hydrophilic contact lens in a sterile aqueous solution. More specifically, the invention pertains to a packaging arrangement wherein a plurality of disposable hydrophilic contact lenses are contained in a specific number of individual packaging arrangements adapted to be collectively housed in a box-like container or carton so as to provide a specified or essentially measured supply of contact lenses for use by a consumer over a predetermined period of time.

In particular, the invention is directed to the aspect of providing an improved attachment between the base members of blister packages housing the contact lenses, and a flexible cover sheet utilized for sealing engagement with the base members.

The packaging of hydrophilic contact lenses in a sterile aqueous solution is well known in the contact lens manufacturing technology. In particular, such packaging arrangements generally consist of so-called blister packages which are employed for the storage and dispensing of the hydrophilic contact lenses by a medical practitioner or to consumer who intends to wear the contact lenses. Generally, such hydrophilic contact lenses, which may be disposable after a single wear or short-term use, are manufactured from suitable hydrophilic polymeric materials. These materials may be, amongst others, copolymers of hydroxyethyl methacrylate containing from about 20% to 90% or more of water, depending upon the polymer composition. Generally, such contact lenses must be stored in a sterile aqueous solution, usually in isotonic saline solution in order to prevent dehydration and to maintain the lenses in a ready-to-wear condition.

2. Discussion of the Prior Art

Heretofore, contact lens manufacturers normally utilized stoppered glass bottles containing sterile saline solutions in which the hydrophilic contact lenses were immersed as storage and shipping containers for individual contact lenses. Each bottle was sealed with a suitable silicone stopper and provided with a metal closure as a safety seal in the configuration of an overcap. When the contact lens was intended to be removed from the bottle for use by a patient, the metal closure safety seal was required to be initially torn off the bottle, thereafter the stopper withdrawn and the lens lifted out from the bottle through the intermediary of a suitable plastic tweezer or pouring the contents out. This entailed the implementation of an extremely complicated procedure, since the contact lens was difficult to grasp and remove from the saline solution contained in the bottle due to the transparent nature of the contact lens which rendered it practically invisible to the human eye.

More recently, containments in the form of blister packages have been developed for hydrophilic contact lenses, and which enable the storage and shipping of the hydrophilic contact lenses in a simple and inexpensive expedient manner, while concurrently facilitating the conveniently easy removal of the contact lens by a practitioner or a patient.

For instance, a blister package which is adapted to provide a sterile sealed storage environment for a disposable or single-use hydrophilic contact lens, wherein the lens is immersed in a sterile aqueous solution; for example, such as in an isotonic saline solution, is described in U.S. Pat. No. 4,691,820 to Martinez; which is assigned to the common assignee of the present application, and the disclosure of which is incorporated herein by reference.

Thus, in the above-mentioned Martinez U.S. patent, the blister package for storing and dispensing a hydrophilic contact lens includes an injection-molded or thermoformed plastic base portion incorporating a molded cavity which is surrounded by an outstanding planar flange about the rim of the cavity. A flexible cover sheet is adhered to the surface of the flange so as to sealingly enclose the cavity in a generally liquid-tight mode. Within the cavity of the base portion, a hydrophilic contact lens is immersed in a sterile aqueous solution, such as an isotonic saline solution. A portion of the side wall of the cavity is inclined to form a ramp extending upwardly towards the flange from the bottom of the cavity, and the cover sheet is adapted to be stripped from the flange in order to expose the cavity and inclined side wall thereof whereupon the lens may be readily manually removed by being slid upwardly and out of the cavity along the inclined ramp surface of the cavity.

Other embodiments of blister packages have the lens-containing cavity shaped to be of an essentially semi-spherical configuration which is dimensioned so as to be adapted to closely support the contact lens therein immersed in an aqueous solution for ease of removal and also to facilitate an inspection process, as disclosed in copending U.S. patent application Ser. Nos. 08/414,513, now abandoned, and 08/414,515, now U.S. Pat. No. 5,620,088 (Attorney's Docket Nos. VTN-169, 9014Z-I and VTN-170, 9014Z-II), also commonly assigned to the assignee of the present application. Moreover, the foregoing construction primarily considers the utilization of such blister packages for the dispensing of individual contact lenses, with such blister packages being ordinarily separate or single packagings, which may then be housed in larger quantities in a further container, such as a rigid cardboard or paperboard carton of usual construction employed for the retail sales of the lenses.

It is an important aspect to be able to furnish a user of such disposable hydrophilic contact lenses with a specific supply of contact lenses, the latter of which are normally worn for only a single day; in essence, for ordinarily 8 to 18 hours within a 24-hour period and thereafter discarded. Hereby, the packaging of a supply of contact lenses should enable the user to store and provide indication for replenishing the supply of contact lenses at regular intervals; for example, at periods of 5, 10, 15, 30 days or even longer. Consequently, provision is made for packaging arrangements including specified quantities of such hydrophilic contact lenses contained in blister packages, such as being in suitable interconnected arrays, wherein these packaging arrangements are adapted to be boxed in a carton enabling a rapid and precise determination as to the quantity of hydrophilic contact lenses contained therein, and with such packaging arrangements being of a compact nature which is completely protective of the hydrophilic lenses.

SUMMARY OF THE INVENTION

In essence, the inventive concept pertains to packaging arrangements in which a plurality of blister packages each has a cavity containing respectively one hydrophilic contact lens in a sterile aqueous solution. A specified quantity of such blister packages has the molded plastic base members thereof each containing a contact lens positioned in a contiguous array, and is initially covered by a single flexible cover sheet constituted of a laminated foil or other materials, such as metallized PET, PC to enhance barrier properties, or a layer of the laminate structure including silicon oxide on a plastic laminate to provide barrier properties in order to provide a sealed environment for each of the contact lenses contained in the cavity formed in each base member. The flexible cover sheet may be dimensioned to cover a single base member to provide an individual or single packaging arrangement, or, in an alternative concept, may be in the form of strips whereby adjoining base members are severable interconnected to enable the dispensing of individual blister packages each containing one of the hydrophilic contact lenses as may be required by a user. In particular, a plurality of such arrays of packaging arrangements for contact lenses, which arrays or individual blister packages are adapted to be arranged in one or more containers.

Each of the blister package base members, which may possess a substantially rectangular outstanding planar flange encompassing a respective contact lens receiving cavity formed therein, the latter of which may be offset towards one end of the flange, and may incorporate integral support structure formulating rigidly supported and compact packaging arrangements such that the cavities containing the hydrophilic contact lenses of superimposed arrays are substantially protected against potentially damaging external influences, such as shocks or impacts which may be imparted thereto during handling thereof.

Each molded plastic base member of a blister package may be constituted from a suitable injection molded or thermoformed thermoplastic sheet material, such as, for instance, polypropylene, PET, PC and other thermoplastic materials; whereas the flexible cover sheet may be constituted of a laminate or other type of barrier material, as mentioned hereinabove, suitably imprinted and which is adapted to be heat-sealed to the flange extending about the cavity of the package containing the hydrophilic contact lens. The flexible cover sheet may be of a material composition and imprinted in a novel manner as is disclosed in copending U.S. patent application Ser. No. 08/106,386; filed on Aug. 13, 1993; entitled "Method of Double-Sided Printing of a Laminate and Product Obtained Thereby", commonly assigned to the assignee of the present application and the disclosure of which is incorporated herein by reference.

In many instances, when arrays of blister packages are formed, in essence, with the base members having the cavities therein containing the hydrophilic contact lenses, the individual base members are positioned on a production line so as not to be in direct contact with each other or only in a closely spaced relationship, whereby the superposition thereon of the flexible cover sheet is implemented through apparatus which does not always accurately position the cover sheet over the collective sequentially spaced blister package base members. Consequently, although the surfaces of the flexible cover sheets facing the individual base members may provide adequate sealing adherence about the periphery or confines of the cavities containing the contact lenses, it may be necessary to provide engagement with at least peripheral surface portions of the flanges extending in spaced relationship about the cavities to form essentially closed and peripherally sealed blister packages without the need for the provision of adhesive materials.

In order to achieve the foregoing sealing or joining effect between the base members and the flexible cover sheet, each of the base members as described hereinbelow may have the peripheral edges of the flange surface provided with a continuously extending groove or recess extending proximate the periphery thereof, so as to enable a pressure die having a configuration complementary to the shape of the groove to force the superimposed flexible cover sheet into sealing engagement with the peripheral groove. Thereafter, the cover sheet may be trimmed and severed to form individual blister packages while permitting the material of the flexible cover sheet which is engaged in the flange groove to form a sealing adherence with the groove wall structure. A corner of the package may be reduced in size in order to more easily enable grasping of the lid or cover sheet so as to start the removal thereof from the package. This will enable the formation of the individual blister packages, each containing respectively one of the hydrophilic contact lenses without the need of having to precisely position the continuous flexible cover sheet over the sequence of blister packages being produced.

Although the foregoing is described with regard to blister packages each containing a hydrophilic contact lens in a generally semi-spherical cavity, this inventive concept is equally applicable to blister packages having the cavity in the shape of a generally rectangular configuration with one upwardly sloping ramp surface as shown in the above-mentioned U.S. Pat. No. 4,691,820 to Martinez. In that instance, it is also possible to form a peripheral groove in the edge portion of the flange surface extending about the rectangular confines of the base member so as to enable the pressure die to force the material of the flexible cover sheet into engagement with the peripheral groove, thereby forming a sealing connection with the base member. The groove additionally serves to prevent the foil or material of the cover sheet from extending beyond the edges of the blister package or base member which, conceivably, could cause jams to occur in downstream processing equipment during production. An embossing die which tucks the cover sheet material into the peripheral groove on the base member is chamfered at one corner so as not to tuck the material into the groove as far at that location. This serves as the point at which the user may grasp the flexible cover sheet and detach and remove it from the base member. A tip of embossing die is designed to "iron out" wrinkles that form naturally during the actual pressing of the foil. In other words, simply tucking foil will cause wrinkling, but this die deforms (draws) the material during insertion so that no wrinkles appear.

Accordingly, it is an object of the present invention to provide a novel construction for blister packages each containing a cavity housing a hydrophilic contact lens immersed in an aqueous solution, whereby a flexible cover sheet is adhered to periphery of a flange of the base portion of the blister package through interengaging surface structure of the components.

A more specific object of the present invention is to provide blister packages for the containment of hydrophilic contact lenses, wherein a planar flange structure of a base member of the package has a peripheral groove formed therein and extending along the edges thereof, into which groove there may be sealingly engaged the material of a flexible cover sheet to provide an attachment of the cover sheet to the base member, while preventing the material from extending beyond the edges of the base member through imparting a reduced size to a corner of the package to mate with a particular section of the embossing die.

Yet another object of the present invention is to provide a method of attaching a flexible cover sheet to a flange portion of a base member for a blister package through effectuating a mechanical sealing engagement between the material of the flexible cover sheet and a groove structure formed in the flange.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
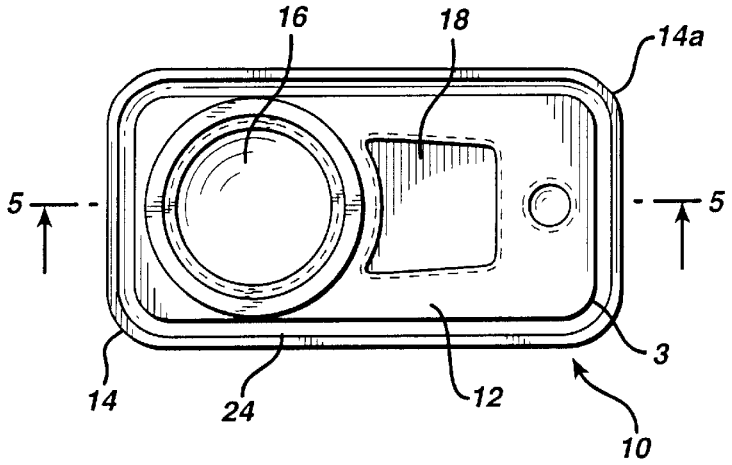
FIG. 1 illustrates a top plan view of a base portion of a blister package base member pursuant to the invention.
Figure 2:
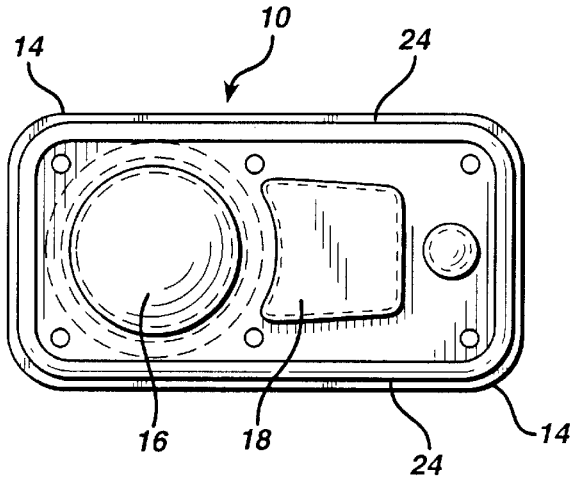
FIG. 2 illustrates a bottom view of the base member.
Figure 3:
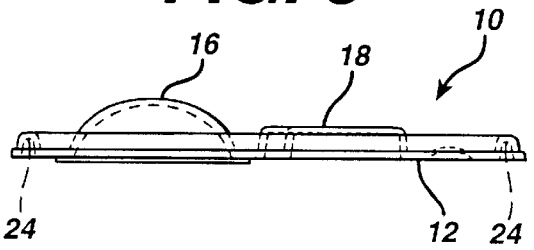
FIG. 3 illustrates a side view of the base member.
Figure 4:
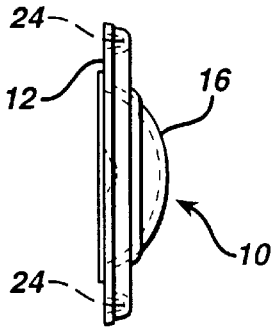
FIG. 4 illustrates an end view of the base member.
Figure 5:
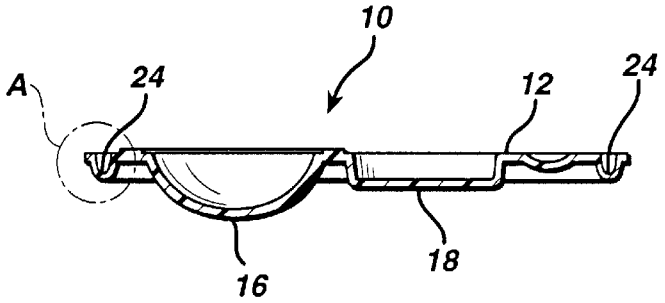
FIG. 5 illustrates a sectional view taken along line 5—5 in FIG. 1.
Figure 6:
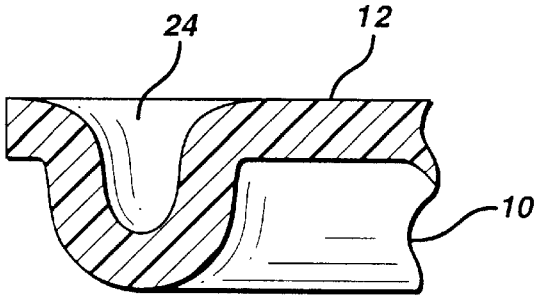
FIG. 6 illustrates, on an enlarged scale, a fragmentary view of he edge portion of the base member shown in the encircled portion A of FIG. 5.
Figure 7:
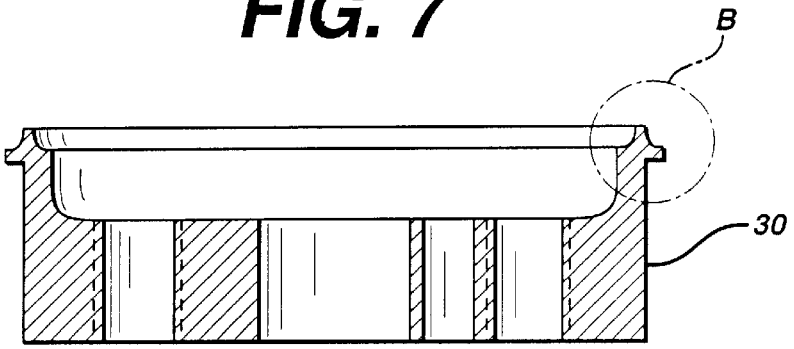
FIG. 7 illustrates a typical pressure die which is adapted to force the material of a flexible cover sheet into a peripheral groove formed in the base member of the blister package.
Figure 8:
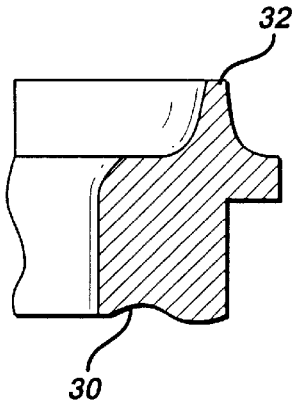
FIG. 8 illustrates an enlarged sectional fragmentary view taken in the encircled portion B of FIG. 7.
Figure 9:
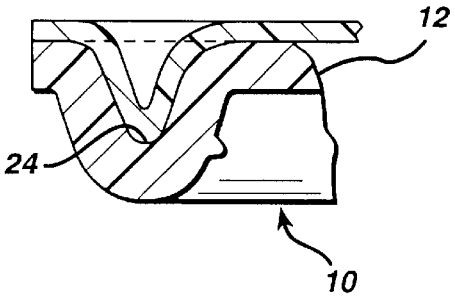
FIG. 9 illustrates, generally diagrammatically, the blister package of FIG. 1, shown with the cover sheet adhered thereto.

Referring now in specific detail to an embodiment of a blister package construction, there is illustrated a base member 10, as shown in FIG. 1, which has a planar flange 12 of generally rectangular configuration in plan view, and which possess rounded end corners 14, although if desired it is also possible to produce the flange 12 with sharp end corners.

Offset towards one end of the flange 12 is a cavity 16 which, in this instance, is of generally semicircular configuration and which is adapted to receive therein a hydrophilic contact lens which is immersed in a sterile saline solution, as is well known in the technology.

Molded into the planar flange 12 proximate the cavity 16 is an indentation or depression 18, which may be of a generally frusto-conical planar configuration, which is coextensive and spaced from the perimeter of the cavity 16, and wherein the depression 18 is formed primarily for the purpose of reinforcing the planar flange 12 and to strengthen the latter against lateral deflection tending to break the seal about the cavity 16 formed with a cover sheet. Imparting pressure against the flexible cover material in this region may also assist in detaching the former from its engagement with the base member.

Formed along the periphery of the rectangular flange 12 and slightly offset inwardly of the edge thereof is a continuous peripheral groove 24 which imparts a stiffening strengthening to the structure of the flange, with an increased radius at one or two corners 14*a* to allow the user to attain an easier grip on the lid or flexible cover sheet. The peripheral groove 24 is adapted to be covered, as is the remaining flange surface, by a flexible cover sheet of the type as described hereinabove, and whereby the surface of the flexible cover sheet extending about the cavity 16 containing the contact lens is adhesively fastened thereto.

In order to provide a sealing or clamping engagement between the surface of the flange 12 facing flexible cover sheet and the latter, a suitable pressure die 30 having a protrusion 32 coextensive with the perimeter of the groove in the flange 12 is forced downwardly into engagement with the surface of the flexible cover sheet so as to force the material thereof into the groove extending along the perimeter of the flange of the blister package base member. The width and depth of the groove is dimensioned to cause a clamping engagement to take place with the flexible cover sheet material which is forced therein by the die 30, so as to essentially provide a mechanical sealing engagement between the cover sheet and the flange 12 of the blister package base member within the confines of the peripheral groove.

In case of an embodiment in which the material of the cover sheet forms an interconnecting strip with portions thereof located externally of the perimeter of the blister package base member, such material may be severed or suitable weakening lines formed therein in order to form a continuous array or strip of a predetermined number of detachably interconnected blister packages.

With respect to the foregoing, although the invention has been described with regard to a blister package having a generally semi-spherical cavity 16 for receiving a contact lens, it is also equally applicable to the flange structure disclosed in U.S. Pat. No. 4,691,820 to Martinez by simply molding a groove into the peripheral edge portion of the generally rectangular flange portion of the base member. This will enable the material of the flexible cover sheet to be pressed into the groove by means of the pressure die, as described hereinabove, and which will provide for a sealing engagement analogous to that in the previously described embodiment.

From the foregoing it becomes readily apparent that by means of the invention incorporating the peripheral groove in the flange portion of a base member for a blister package, through a simple cooperating pressure die structure, it is possible to cause the superimposed flexible cover sheet to come into clampingly sealing engagement with the peripheral groove in the flange portion to resultingly form a mechanical seal between the flexible cover sheet and the periphery of the base member of the blister package. This will enable the production of blister packages in a continuous and sequential manner without the necessity for having to consider minor deviations and tolerances in the positioning of the flexible cover sheet over subsequent or sequentially produced blister packages, inasmuch as the latter will always be aligned in cooperation with the pressure die superimposed thereover for the formation of the sealing engagement with the groove in the base member.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A method for sealingly containing at least one contact lens in a sterile aqueous solution, said method comprising the steps of:

(a) superimposing a flexible cover sheet over at least one plastic base member, each of said at least one plastic base member having a cavity for containing a contact lens immersed in a sterile aqueous solution, each of said at least one plastic base member including a generally planar flange extending outwardly about the periphery of each cavity, each cavity consisting of an indentation extending from the plane of each flange of each of said at least one plastic base member and a continuous peripheral groove formed in the plane of each flange and extending closely inwardly of the peripheral edge of each flange, said cover sheet dimensioned to be detachably sealed to a surface area of each flange extending about each cavity, said cover sheet having portions thereof located in alignment with each peripheral groove; and (b) embossing said portions of said cover sheet into each peripheral groove so as to form a clamping engagement with each flange coextensive with each peripheral groove.

2. The method of claim 1, wherein the material of said flexible cover sheet is pressed into each groove in each flange through the application of an embossing die.

3. The method of claim 2, wherein said embossing die includes a raised pressing surface aligned in conformance with the peripheral dimensions of each groove in each groove.

4. The method of claim 1, wherein said cover sheet has an expanse which is dimensioned to be within the confines of the peripheral edges of a single one of said at least one plastic base member.

5. The method of claim 1, wherein said cover sheet is dimensioned to interconnect a plurality of said at least one plastic base member in a striplike array for the containment of a specified plurality of contact lenses arranged one in each cavity of each of said at least one plastic base member.

6. The method of claim 1, wherein an indentation is formed in the surface of each flange intermediate each cavity and each peripheral groove.

* * * * *